United States Patent [19]

Komminoth et al.

[11] 4,125,652

[45] Nov. 14, 1978

[54] TREATMENT PROCESS FOR TEXTILE SUBSTRATES COMPRISING REGENERATED CELLULOSE

[75] Inventors: Paul Komminoth, Therwil; Tibor Robinson, Birsfelden; Milica Urosevic, Basel, all of Switzerland

[73] Assignee: Sandoz Ltd., Basel, Switzerland

[21] Appl. No.: 796,640

[22] Filed: May 13, 1977

[30] Foreign Application Priority Data

May 20, 1976 [CH] Switzerland ..... 6349/76

[51] Int. Cl.[2] ..... D06M 13/14; D06M 13/22; D06M 13/38

[52] U.S. Cl. ..... 427/390 C; 8/183; 8/186; 8/184; 8/185; 260/29.4 R; 260/849; 427/394

[58] Field of Search ..... 260/29.4 R, 849; 8/183, 8/184, 185, 186; 427/390 C, 394

[56] References Cited

U.S. PATENT DOCUMENTS

| | | | |
|---|---|---|---|
| 2,785,948 | 3/1957 | Abrams | 427/394 X |
| 2,785,949 | 3/1957 | Kross | 427/394 X |
| 3,015,584 | 1/1962 | Reinhardt et al. | 427/384 X |
| 3,617,197 | 11/1971 | Ulrich | 8/183 X |
| 3,933,426 | 1/1976 | Martini et al. | 8/183 |

FOREIGN PATENT DOCUMENTS

| | | | |
|---|---|---|---|
| 2,135,437 | 7/1971 | Fed. Rep. of Germany | 8/183 |

*Primary Examiner*—Michael R. Lusignan
*Attorney, Agent, or Firm*—Gerald D. Sharkin; Richard E. Vila; Joseph J. Borovian

[57] ABSTRACT

Disclosed is a treatment process for textile substrates comprising or consisting of regenerated cellulose, which process comprises applying to the substrate an aqueous medium comprising (A) a monomeric, hydrolysis stable, hydrosoluble, resin forming cross linking agent containing at least two N-methylol or N-alkoxymethyl groups, (B) a hydrosoluble, prepolymerised, linear, filler resin forming, cross-linking agent, also containing at least two N-methylol or N-alkoxymethyl groups, (C) a reactive acetal of formula

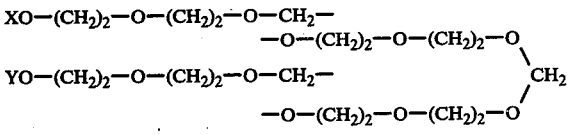

wherein X and Y, independently, are H or $CH_2OH$, (D) a first cross-linking catalyst, being an alkaline earth metal salt of a strong acid and (E) a second cross-linking catalyst, being an acidic aluminium salt, subsequently drying the substrate and subjecting same to a temperature at which cross-linking takes place, and an aqueous concentrate for use therein.

23 Claims, No Drawings

TREATMENT PROCESS FOR TEXTILE SUBSTRATES COMPRISING REGENERATED CELLULOSE

The invention relates to a treatment process for textile substrates comprising or consisting of regenerated cellulose, which process comprises applying to the substrate an aqueous medium comprising (A) a monomeric, hydrolysis stable, hydrosoluble, resin forming cross-linking agent containing at least two N-methylol or N-alkoxymethyl groups, (B) a hydrosoluble, prepolymerised, linear, filler resin forming, cross-linking agent, also containing at least two N-methylol or N-alkoxymethyl groups, (C) a reactive acetal of formula

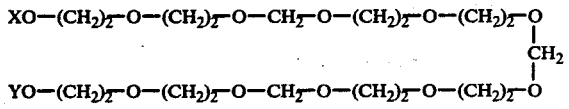

wherein X and Y, independently, are H or $CH_2OH$, (D) a first cross-linking catalyst, being an alkaline earth metal salt of a strong acid and (E) a second cross-linking catalyst, being an acidic aluminium salt, subsequently drying the substrate and subjecting same to a temperature at which cross-linking takes place.

The hydrolysis stable N-methylol compounds employed as component (A) are suitably those described in Textil-Veredlung 3, No. 8, 414–415 (1968). Preferred compounds for use as component (A) are the N,N'-dimethylol and N,N'-dialkoxymethyl derivatives of 4,5-dihydroxy or 4,5-dimethoxyethylene urea or of 4-methoxy-5,5-dimethylpropylene urea, and the N,N-dimethylol and N,N-dialkoxymethyl derivatives of carbamates, especially of methyl or ethyl carbamate. The N-alkoxymethyl compounds preferably contain 1 to 5 carbon atoms in the alkoxy moiety and are suitably produced by etherification, employing suitable alcohols, of the corresponding methylol compounds. As examples may be given the methoxymethyl, ethoxymethyl, n-butoxymethyl, n-amyloxymethyl and isobutoxymethyl derivatives of the above mentioned alkylene ureas.

The preferred compounds for use as component (B) are water soluble linear precondensates of N-methylol or N-alkoxymethyl derivatives of urea or melamine of a chain length sufficiently short to enable penetration into at least partially swollen regenerated cellulose fibres. Especially preferred a dimethylol urea in dimeric to tetrameric form and the corresponding $C_{1-5}$alkoxymethyl derivatives.

The preferred compounds for use as component (D) are magnesium and calcium chloride and sulphate, the magnesium compounds being especially preferred, particularly magnesium chloride.

By "acidic aluminium salt", is meant an aluminium salt capable of acting as a proton donator. The preferred such salts are aluminium chloride, sulphate, dihydrogen phosphate, nitrate or oxychloride, preferably the chloride, nitrate, dihydrogen phosphate or sulphate, most preferably the chloride.

By choosing appropriate concentrations of the components, the aqueous medium can be a true solution, as is preferred. Indeed, surprisingly, in view of the normally non-hydrolysis-stable nature of component (B), storable solutions for use in the process can be obtained. The preferred concentration ranges in such solutions of components (A), (B) and (C) are, respectively, 10–100 g/l, 5–50 g/l and 10–100 g/l, more preferably 20–50 g/l, 10–25 g/l and 20–50 g/l, most preferably 40–50 g/l, 20–25 g/l and 40–50 g/l.

Suitable weight ratios of components A:B:C:D:E are 10–80:5–40:10–80:2.5–20:0.5–4, preferably 20–40:10–20:20–40:5–10:1–2, most preferably 1:0.5:1:0.25:0.05 with ±25% variation for each component, such weight ratios being based on the water-free weight of the components, although the compounds may, where available, be employed in hydrated form, e.g. magnesium chloride as component (D) would generally be employed in hexahydrate form ($MgCl_2.6H_2O$), in which case its weight ranges in the above ratios would be about 5–40, 10–20 and 0.5.

The aqueous media employed in the process of the invention form a further feature of the invention. Such aqueous media are preferably obtained by dilution of corresponding aqueous concentrates, although they may be made up by individual addition of the components to water. Such concentrations form a further feature of the invention. A particularly preferred liquid aqueous concentrate provided by the invention contains, per 1000 parts by weight of concentrate, 165–275 parts by weight of component (A), 81–135 parts by weight of component (B), 162–270 parts by weight of component (C), 45–75 parts by weight of component (D) and 7.5 to 12.5 parts by weight of component (E), again based on the water-free state of the components, the balance being water and optionally further additives as described below, but preferably being water alone. Such preferred concentrates are water clear solutions with good storage properties.

In addition to the components (A) to (E), above, the aqueous medium applied to the substrate may contain conventional finishing agents such as optical brighteners, non-slip agents, abrasion and tensile strength improving agents, soil release agents and hydrophobing agents. Such agents are generally added to the aqueous medium immediately prior to carrying out the process of the invention. However, where water-soluble and having good compatibility with components (A) to (E), they may be incorporated in the concentrates of the invention.

In the process of the invention, the aqueous medium may be applied to the substrate in conventional manner, suitably the substrate being impregnated, e.g. using padding techniques. The pick-up is generally of the order of from 60 to 120%, preferably from 70 to 100% and most preferably from 85 to 90%, depending, of course, on the method of application, the nature of the substrate, e.g. the amount of non-regenerated cellulose therein, and the concentration of the cross-linking agents in the medium. After application of medium, usually effected at room temperature, the substrate is dried and cured, i.e. cross-linking is caused to take place. Where the drying and curing steps are carried out separately, the drying is suitably carried out at from 70° to 120° C., the curing generally at 130° to 180° C., the latter step generally taking from 2 to 8 minutes, except where rapid curing techniques, at 180°–200° C., are employed where from 30–60 seconds only are required. Where the drying and curing steps are carried out simultaneously, as is often appropriate with light-weight fabrics, such is generally carried out at from 160° to 200° C., suitably on a stenter.

The substrate may consist solely of regenerated cellulose or comprise regenerated cellulose in blend form with other fibres, both natural and synthetic, e.g. cotton or polyester, and may be in any conventional, preferably textile, form, e.g. in fibre, thread, woven or other fabric form. The blend substrates preferably contain at least 20% by weight of regenerated cellulose.

By the process of the invention, which is a dry cross-linking process, the crease recovery of the substrate, both wet and dry, is improved as is its resistance to swelling in neutral and alkaline aqueous media. The hydroelasticity thereof is also reduced. Of particular interest, however, is the wet crease resistance of the substrate and the relative permanence thereof even after several subsequent washes.

The following Examples in which all parts and percentages, unless otherwise stated, are by weight and in which all temperatures are in degrees centigrade, illustrate the invention.

EXAMPLE 1

A fabric consisting of 100% rayon staple fibre is impregnated with the following solution at room temperature, and is squeezed out to 95–90% moisture increase.

The solution contains:

45 g/l of dimethyloldihydroxyethylene-urea (A)
20 g/l of pre-polymerised dimethylolurea with 2–3 methylol groups (B)
45 g/l of glycol acetal (C) of formula:

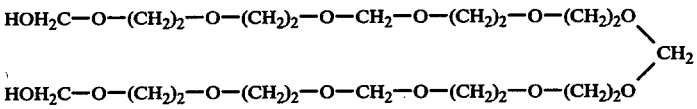

24 g/l of magnesium chloride ($MgCl_2 . 6H_2O$) (D)
2 g/l of aluminium chloride ($AlCl_3$-anhydrous) (E)
10 g/l of a commercial softener (alkylmonomethylol type of compound)
1 g/l of a commercial wetting agent (alkylpolyglycol ether type)

Dry cross-linking process (Pad-Dry-Cure)

Pre-drying : 2 minutes at 120°
Curing : 3 minutes at 150°

The permanency of the finishing effects upon washing is tested by washing 1–5 times in a machine at 60°, and adding 2 g/l of a commercial washing agent.

A fabric with excellent technical properties is obtained.

EXAMPLE 2

A 100% "Polynosic-Vincel" 64 fabric is impregnated with the following mixture as a solution at room temperature, and is squeezed out to about 85–90% moisture increase:

33 g/l of dimethyloldihydroxyethylene-urea (A)
16 g/l of pre-polymerised dimethylolurea (B) of Example 1
33 g/l of glycol acetal (C) of Example 1
18 g/l of magnesium chloride ($MgCl_2 . 6H_2O$) (D)
1.5 g/l of aluminium chloride ($AlCl_3$ anhydrous) (E)
10 g/l of softener (alkylmonomethylol type of compound)
1 g/l of wetting agent (alkylpolyglycol ether type)

Dry cross-linking process (a) - Pad-Dry-Cure

Pre-drying: 2 minutes at 120°
Curing: 3 minutes at 150°

Dry cross-linking process (b) Pad-Dry-Rapid-Cure

Pre-Drying: 2 minutes at 120°
Curing: 30 minutes at 180°

Dry cross-linking process (C) - Flash-Cure

One-stage drying/curing: 60 seconds at 180°

A fabric with excellent technical properties is obtained.

EXAMPLE 3

A mixed fabric of 50% "Polynosic"/50% cotton is impregnated on a dye-padder with the following solution:

40 g/l of dimethyloldihydroxyethylene-urea (A)
15 g/l of pre-polymerised dimethylolurea (B) of Example 1
35 g/l of glycol acetal (C) of Example 1
18 g/l of magnesium chloride ($MgCl_2$ — $6H_2O$) (D)
1.5 g/l of aluminium chloride ($AlCl_3$ anhydrous) (E)
10 g/l of softener (fatty acid ester type)
1 g/l of wetting agent (alkylpolyglycol ether type)

it is then squeezed out to 85–90% residual moisture and in one stage pre-dried and cured for 1 minute at 185°, (b) in two stage pre-dried for 2 minutes at 120° and cured for 3 minutes at 150°.

The permanency of the finishing effects upon washing is tested by washing 5 times in a machine at 160°, and adding 2 g/l of a commercial washing agent.

A fabric with excellent technical properties is obtained.

EXAMPLE 4

A 100% viscose fabric is treated in a pad-dyeing process (to 85–90% residual moisture) with a solution consisting of:

35 g/l of dimethyloldihydroxyethylene-urea (A)
15 g/l of pre-polymerised dimethylolurea (B) of Example 1
35 g/l of glycol acetal (C) of Example 1
18 g/l of magnesium chloride ($MgCl_2 . 6H_2O$) (D)
1.5 g/l of aluminium chloride ($AlCl_3$ anhydrous) (E)
20 g/l of a commercial hydrophobing agent (paraffin dispersing containing zirconium)
20 g/l of a commercial non-slip agent ($SiO_2$ dispersion)

The fabric is dried and cured in a one-stage process for 1 minute at 185° and has very good technical values.

EXAMPLE 5

A mixed fabric of polyester/rayon staple fibre 70/30 is impregnated with the following solution in the pad-dyeing process at a moisture absorption rate of 70–75:

22.5 g/l of dimethyloldihydroxyethylene-urea (A)
10.5 g/l of pre-polymerised dimethylolurea (B) of Example 1
21 g/l of glycol acetal (C) of Example 1
12 g/l of magnesium chloride ($MgCl_2 . 6H_2O$) (D)
1 g/l of aluminium chloride ($AlCl_3$ anhydrous) (E)
10 g/l of a commercial polyethylene dispersion
5 g/l of softener (fatty acid condensation product)
1 g/l of wetting agent (polyglycol ether type)

It is subsequently dried and cured in the one-stage shock process for 60 seconds at 185°.

The technical values of the fabric are excellent, particularly with regard to elasticity.

What is claimed is:

1. A treatment process for textile substrates comprising or consisting of regenerated cellulose, which process comprises applying to the substrate an aqueous medium comprising an effective amount of each of: (A) a monomeric, hydrolysis stable, hydrosoluble, resin cross-linking agent containing at least two N-methylol or N-alkoxymethyl groups, (B) a hydrosoluble, prepolymerized, linear, filler resin forming, cross-linking agent, also containing at least two N-methylol or N-alkoxymethyl groups, (C) a reactive acetal of formula

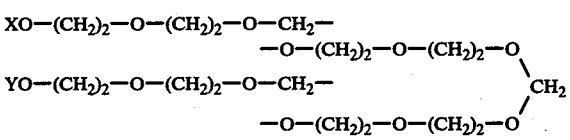

wherein X and Y, independently, are H or $CH_2OH$, (D) a first cross-linking catalyst, being an alkaline earth metal salt of a strong acid and (E) a second cross-linking catalyst, being an acidic aluminium salt, subsequently drying the substrate and subjecting same to a temperature at which cross-linking takes place.

2. The process of claim 1, wherein component (A) is an N,N'-dimethylol or N,N'-dialkoxymethyl derivative of 4,5-dihydroxy- or 4,5-dimethoxy-ethylene urea or of 4-methoxy-5,5-dimethylpropylene urea or an N,N-dimethylol or N,N-dialkoxymethyl derivative of a carbamate.

3. The process of claim 2, wherein, in any dialkoxymethyl compound, the alkoxy moiety is of 1 to 5 carbon atoms, and wherein said carbamate is methyl or ethyl carbamate.

4. The process of claim 1, wherein component (B) is dimethylol or di-$C_{1-5}$-alkoxymethyl urea in dimeric to tetrameric form.

5. The process of claim 1, wherein component (D) is magnesium or calcium chloride or sulphate.

6. The process of claim 5, wherein component (D) is magnesium sulphate or chloride.

7. The process of claim 6, wherein component (D) is magnesium chloride.

8. The process of claim 1, wherein component (E) is aluminium chloride, sulphate, dihydrogen phosphate, nitrate or oxychloride.

9. The process of claim 8, wherein component (D) is aluminium chloride, nitrate, dihydrogen phosphate or sulphate.

10. The process of claim 8, wherein component (E) is aluminium chloride.

11. The process of claim 1, wherein the weight ratio of components A:B:C:D:E is 10–80:5–40:10–80:2-.5–20:0.5–4, based on the water-free weight of each component.

12. The process of claim 11, wherein said weight ratio is 20–40:10–20:20–40:5–10:1–2.

13. The process of claim 12, wherein said weight ratio is 1:0.5:1:0.25:0.05 with ±25% variation for each component.

14. The process of claim 1, wherein the concentration ranges of components A, B and C in the aqueous medium are 10–100 g/l, 5–50 g/l and 10–100 g/l, respectively.

15. The process of claim 14, wherein said ranges are 20–50 g/l, 10–25 g/l and 20–50 g/l.

16. The process of claim 14, wherein said ranges are 40–50 g/l, 20–25 g/l and 40–50 g/l.

17. The process of claim 1, wherein the pick-up of the medium, based on the weight of the substrate is from 60 to 120%.

18. The process of claim 17, wherein said pick-up is from 70 to 100%.

19. The process of claim 18, wherein said pick-up is from 85 to 90%.

20. The process of claim 1, wherein drying and cross-linking are carried out separately, the drying at from 70° to 120° C., the cross-linking at 130° to 200° C.

21. The process of claim 1, wherein drying and cross-linking are carried out simultaneously at from 160° to 200° C.

22. The process of claim 1, wherein component (A) is an N,N'-dimethylol or N,N'-di($C_{1-5}$)alkoxymethyl derivative of 4,5-dihydroxy or 4,5-dimethoxy-ethylene urea or of 4-methoxy-5,5-dimethylpropylene urea or an N,N-dimethylol or N,N-di($C_{1-5}$)-alkoxymethyl derivative of methyl or ethyl carbamate, component (B) is dimethylol or di-$C_{1-5}$alkoxymethyl urea in dimeric to tetrameric form, wherein component (D) is magnesium or calcium chloride or sulphate and component (E) is aluminium chloride, sulphate, dihydrogen phosphate, nitrate or oxychloride and wherein the weight ratio of A:B:C:D:E is 10–80:5–40:10–80:2.5–20:0.5–4 based on the water free weight of each component.

23. The process of claim 22, wherein the concentration ranges of components A, B and C in the aqueous medium are 20–50 g/l, 10–25 g/l and 25–50 g/l, and wherein the pick-up of the medium on the substrate is from 70 to 100%.

* * * * *